US005394817A

United States Patent [19]

Kaufman

[11] Patent Number: 5,394,817

[45] Date of Patent: Mar. 7, 1995

[54] COLLAPSIBLE DRIFT SOCK

[76] Inventor: Stewart Kaufman, P.O. Box 458, Freeman, S. Dak. 57029

[21] Appl. No.: 218,702

[22] Filed: Mar. 28, 1994

Related U.S. Application Data

[63] Continuation of Ser. No. 17,660, Feb. 12, 1993, abandoned.

[51] Int. Cl.[6] ..... B63B 21/48

[52] U.S. Cl. ..... 114/311

[58] Field of Search ..... 114/294, 311; 383/67, 383/72, 76

[56] References Cited

U.S. PATENT DOCUMENTS

| | | | |
|---|---|---|---|
| 332,898 | 12/1885 | Hart | 114/311 |
| 578,562 | 3/1897 | Hart | 114/311 |
| 717,890 | 1/1903 | Miller | 114/311 |
| 728,330 | 5/1903 | Temperley et al. | 114/311 |
| 1,117,189 | 11/1914 | Jackson | 114/311 |
| 1,459,599 | 6/1923 | Minor | 383/67 |
| 2,818,042 | 12/1957 | Manhart | 114/311 |
| 4,481,900 | 11/1984 | Rutten et al. | 114/311 |
| 4,534,306 | 8/1985 | Rutten et al. | 114/311 |
| 4,733,628 | 3/1988 | Baughman | 114/311 |
| 5,025,746 | 6/1991 | Boulter | 114/311 |

FOREIGN PATENT DOCUMENTS

| | | | |
|---|---|---|---|
| 2146302 | 3/1973 | Germany | 114/311 |

*Primary Examiner*—Sherman Basinger
*Attorney, Agent, or Firm*—Haugen and Nikolai

[57] ABSTRACT

A sea anchor or boat drag apparatus formed from a cylindrical tubular body and designed for inflated deployment from a fishing boat or the like and arranged to provide controllable or selectable drag forces ranging from zero drag force to a substantial drag force. The cylindrical tubular body is provided with a mooring line and a flow control line, with the mooring line being arranged for attachment to the hull of the boat, and with the flow control line being arranged to control the size or magnitude of the outlet of the cylindrical tubular body, thereby constricting the flow of water through the cylindrical tubular body.

7 Claims, 4 Drawing Sheets

COLLAPSIBLE DRIFT SOCK

This is a continuation of application Ser. No. 08/017,660, filed on Feb. 12, 1993, and now abandoned.

BACKGROUND OF THE INVENTION

The present invention relates generally to a sea anchor or boat drag means which is designed for deployment from a fishing boat or the like, and which is further arranged for providing a controllable or selectable drag to the boat, with the drag force ranging from essentially zero up to a substantial force. Sea anchors have been used in the past for emergency purposes, as well as for providing an efficient and predictable drag force to a fisherman's boat in order to assist the fisherman in moving at a predetermined and desirable rate of speed.

In normal fishing activities, a fisherman will frequently wish to troll or otherwise move across his desired fishing area or zone. This can be achieved by a variety of techniques, such as rowing, trolling with the aid of an engine or outboard motor, or by utilizing a sea anchor or boat drag means. Sea anchors have become a desired and popular drag means for use by fishermen, particularly when such a device can be utilized to provide efficient, noisefree, controlled movement across the water without contributing or adding to pollution from ordinary internal combustion engines. As a further feature, when a marine engine or outboard motor drives the boat at a rate which is greater than desired, a sea anchor may be employed to reduce the speed of the craft to a more desired rate.

By way of emergency utilization, sea anchors can be and have been employed when a boat becomes disabled during times of high or substantial winds. The sea anchor, when attached to the bow of a boat will keep the bow pointed into the wind so as to provide an added degree of safety, and to avoid having the craft subjected to wave action approaching the boat laterally, and thereby risk water splashing over the gunwales, and ultimately endangering the occupants through unintentional swamping of the boat or vessel.

SUMMARY OF THE INVENTION

As indicated above, however, the sea anchor of the present invention is designed for use by fishermen while engaged in sport fishing, and is designed to provide an adjustable drag force which ranges from essentially zero, up to modest, moderate, and even substantial drag forces. The sea anchor device of the present invention is provided with a means for adjusting the configuration of the body of the sea anchor so as to provide a drag which may range from a drag force of essentially zero up to a higher and desired drag.

The sea anchor drag means of the present invention is of fabric construction, and includes a tubular cylindrical body with a central axis, and with a water flow inlet at the proximal end thereof, and with an outlet at the opposed distal end thereof. Mooring lines are provided for attaching the sea anchor to the vessel, such as a fishing boat, with the mooring means including lines for deploying the sea anchor at a desired distance from the boat. Flow control means are provided for adjustably constricting the size of the outlet opening, with the flow control being achieved by positioning a line to adjust and/or otherwise control the size of the outlet opening.

As indicated above, the sea anchor comprises a cylindrical tubular body, with this configuration having been found to be desirable for a number of reasons. The cylindrical tubular configuration enhances the ability of the sea anchor to provide a full range of drag forces, with the drag ranging from essentially zero up to and through modest, moderate, and substantial ranges. This is achieved through adjusting the size of the outlet by a control line, with this size being appropriately selected by the sport fisherman to accommodate the existing conditions.

Therefore, it is a primary object of the present invention to provide an improved sea anchor drag means for use by sport fishermen to adjustably control drag of a fishing boat through fishing waters, and to maintain the boat in a desired orientation relative to the wind, such as being oriented directly into the wind.

It is a further object of the present invention to provide an improved sea anchor drag means for use by sport fishermen, wherein the drag means comprises a fabric body of cylindrical tubular configuration, and with an inlet at the proximal end and an outlet at the distal flow end, and with the size of the outlet opening being adjustably controllable, and permitting constriction of the size to that desired by the user to adjust and/or control drag forces.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
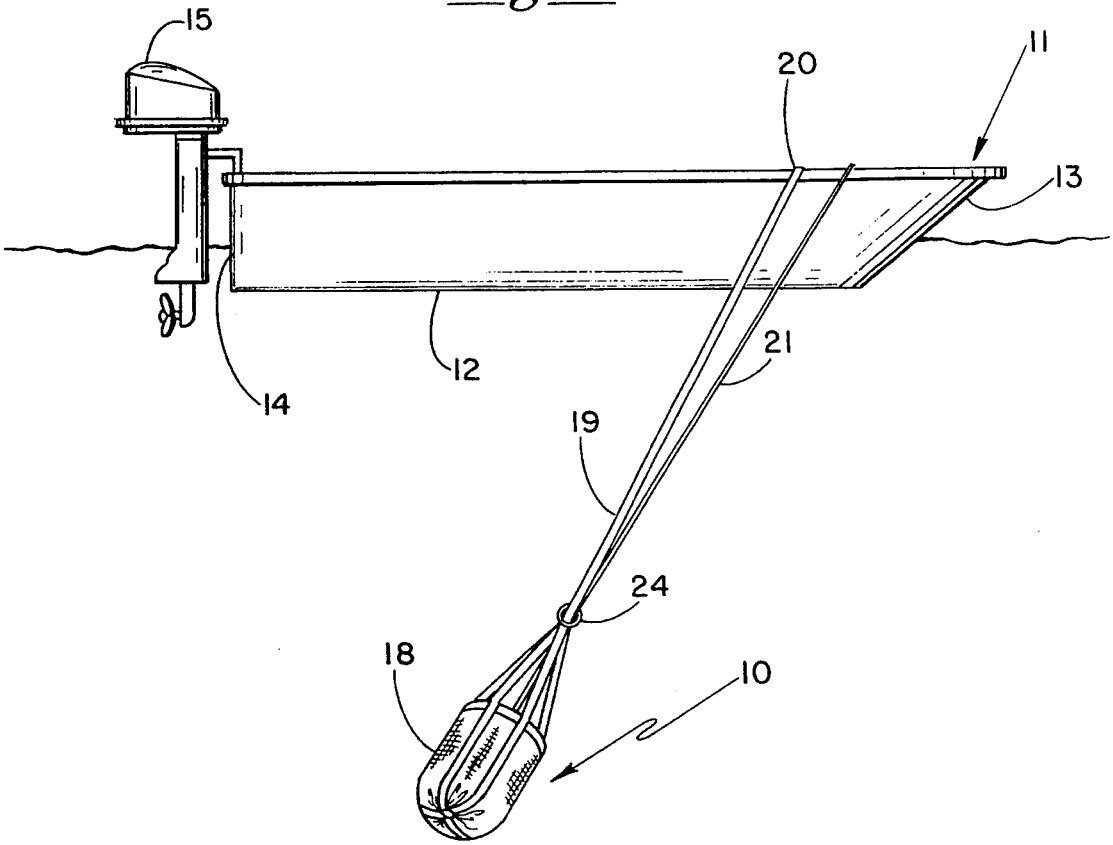
FIG. 1 is a side view of a typical sport fishing boat to which a sea anchor fabricated in accordance with the present invention is attached, with the sea anchor being attached to the bow portion of the fishing boat.

In accordance with the preferred embodiment of the present invention, and with particular attention being directed to FIG. 1 of the drawings, the sea anchor assembly or drag means generally designated 10 is shown attached to the bow portion of a fishing boat generally designated 11, with boat 11 comprising a hull 12 with a bow 13 and a stern 14. A conventional or typical outboard motor 15 is shown attached to the stern 14.

Sea anchor assembly 10 includes cylindrical tubular body 18 having a central axis, and with mooring lines as at 19 being utilized to couple the cylindrical tubular body 18 to the vessel or boat 11 as at 20. Control line 21 is also illustrated in FIG. 1, with control line 21 extending to the vessel as well for controlled positioning of the outlet opening of cylindrical tubular body 18.

With respect to the relative positioning of the various devices illustrated in FIG. 1, it will be noted that the sea anchor assembly is illustrated as depending laterally from the watercraft or boat. This is undertaken for purposes of illustration only, and for greater ease in draftsmanship. In a typical situation, and when deployed, the sea anchor assembly device will tend to turn the craft at an angle relative to the wind which is dependent upon the point of attachment of the sea anchor assembly 10 to the watercraft. Such point of attachment would be selected by the user as being desirable under the existing circumstances, all of which are well known to those users of this type of apparatus.

Figure 2:
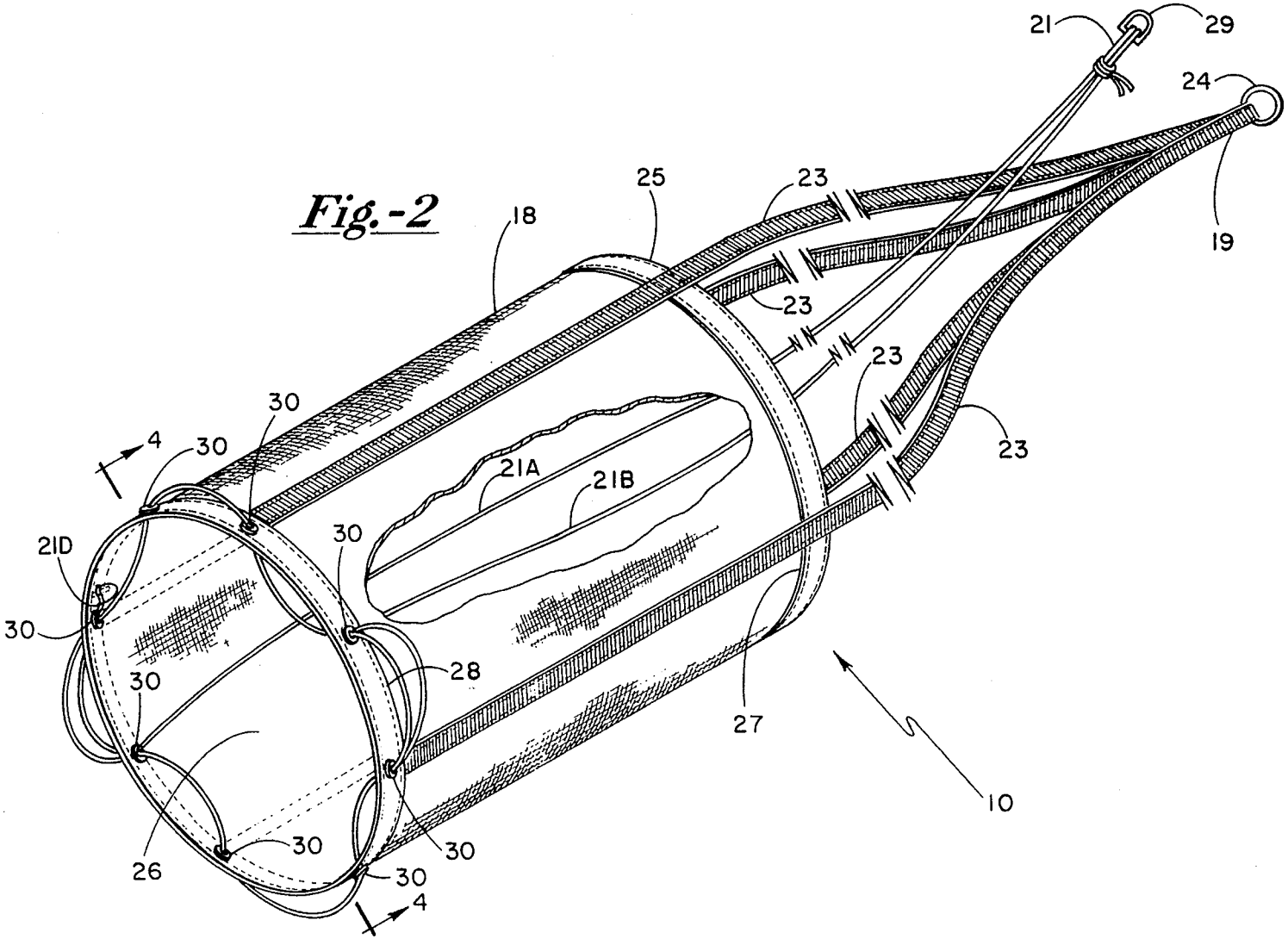
FIG. 2 is a perspective view of the sea anchor of the present invention in fully deployed position, and illustrating the configuration with the outlet being fully opened, and thereby providing essentially zero drag.
Figure 3:
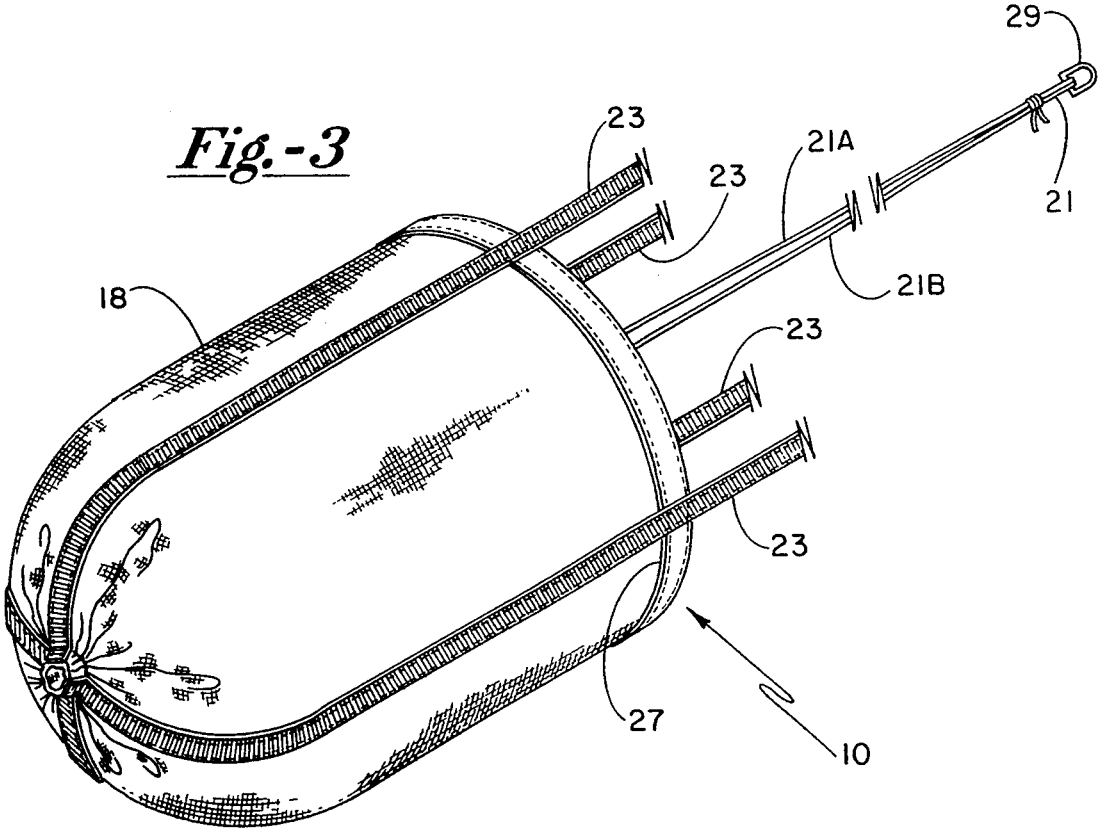
FIG. 3 is a view similar to FIG. 2, and illustrating the sea anchor in a disposition wherein the outlet opening is substantially fully constricted and/or closed, thereby providing the maximum drag force.

With attention now being directed to FIG. 2 of the drawings, mooring means 19 include a plurality of web members 23—23, with these web members being at least four in number, each equal in length, and being coupled to the cylindrical tubular body 18 at equally arcuately spaced dispositions therearound. However, it is recognized providing three equally spaced webs 23—23 would be a functional arrangement, and limitation to a minimum of four webs 23—23 is not to be inferred. Webs 23—23 extend in a line generally parallel to the central axis of the cylindrical tubular body, so as to provide for appropriate and constant mooring and deployment. Webs 23—23 are formed by a pair of straps each threaded through a stainless steel ring 24, as shown. The inlet opening 25 is at the proximal end of cylindrical tubular body 18, with the outlet opening being shown at the distal end 26. Reinforced webbing is also provided along and about the periphery of inlet opening 25 and outlet opening 26, as at 27 and 28 respectively.

Figure 4:
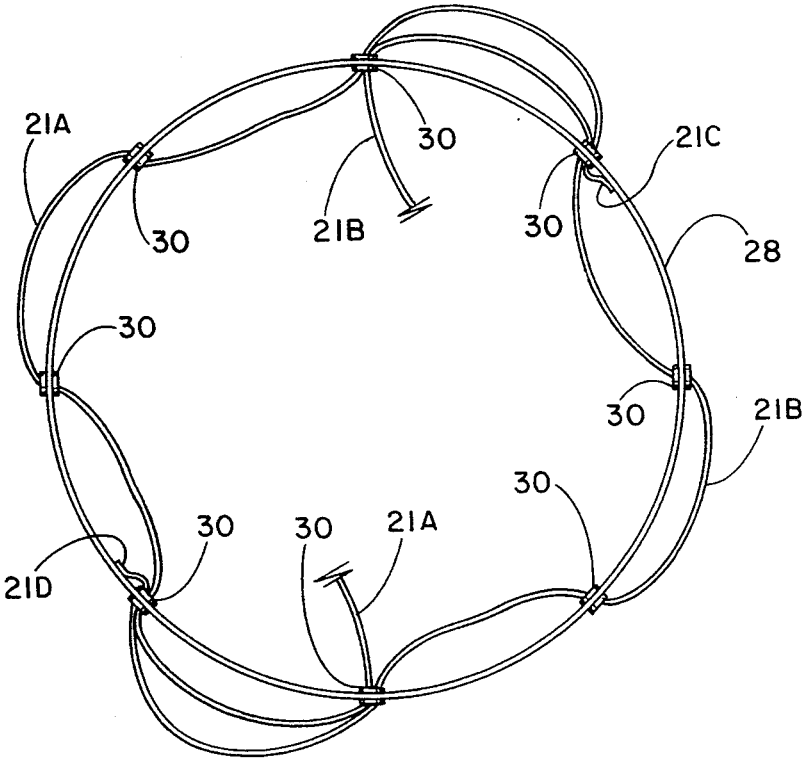
FIG. 4 is a view taken along the line and in the direction of the arrows 4—4 of FIG. 2, and illustrating the manner in which the control line is secured to the structure.

Control line 21 is also illustrated in FIG. 2, with this line including segments 21A and 21B. These segments are coupled together at "D" ring 29, and extend to and through a series of grommets 30—30 positioned at arcuately spaced dispositions along webbing 28. For example, line segment 21A moves from ring 29 through grommets 30—30 which occupy essentially 180° of arc of outlet opening 26, with line segment 21B occupying the other 180° of arc. As is indicated, lines 21A and 21B pass through common grommets, where each enters the initial grommet from the inner side, and through tubular body 18 opposite one another. The terminal ends of both lines 21A and 21B are sewn to the inner surface of tubular body 18 proximate reinforcement 28, and proximate the grommet 30—30 adjacent the grommet 30—30 that the other line enters through, as shown. A specific designation of the arrangement of line segments 21A and 21B is shown in FIG. 4, along with their terminating ends as at 21C and 21D.

Figure 5:
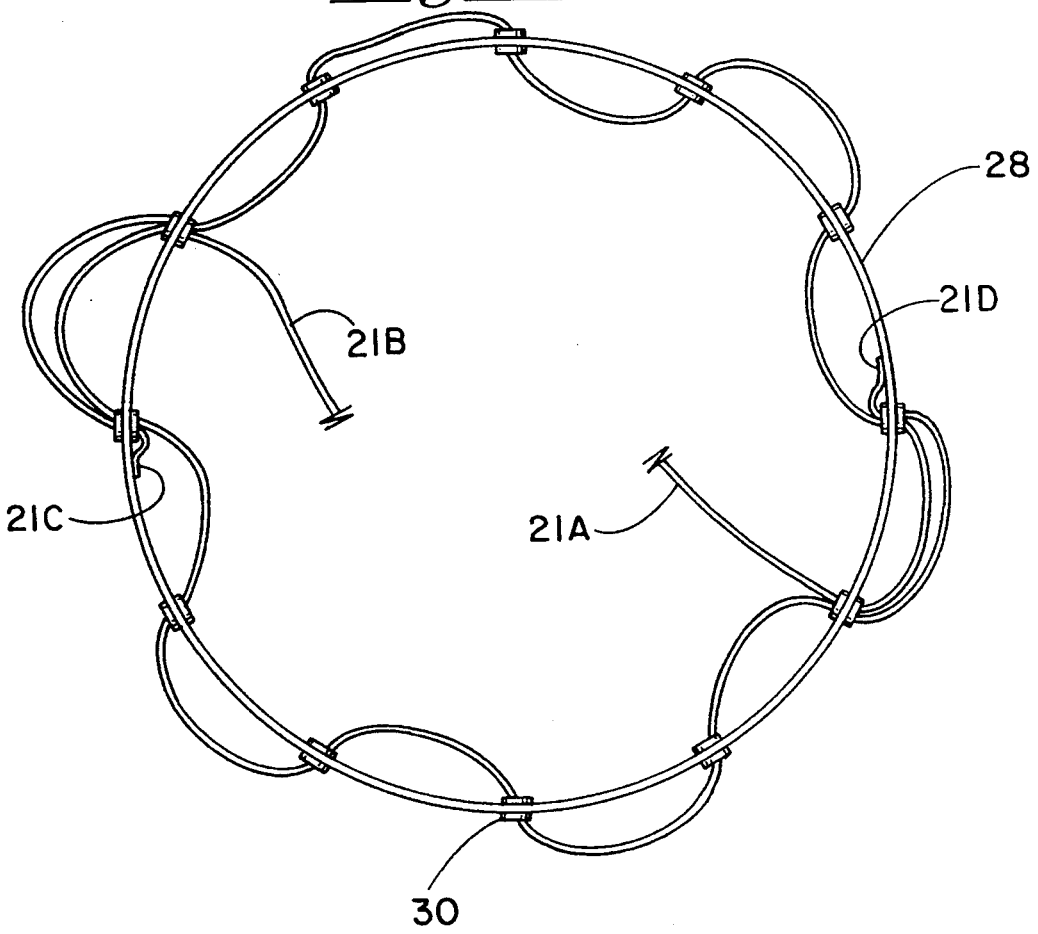
FIG. 5 is an alternative preferred embodiment of the invention including twelve grommets.

As is indicated, the cylindrical tubular body 18 is an elongated tubular member with a constant diameter from the inlet opening to the outlet opening. Line receiving grommets 30—30 are provided at the outlet end in order to accommodate line segments 21A and 21B, and thus control the size of the outlet opening for modifying drag. The diameter of the outlet end is selectively established by the user by adjustably establishing the length of both lines 21A and 21B relative to the length of the mooring line 19. The shorter the lines 21A and 21B relative to the length of mooring line 19, the smaller the established diameter of the outlet end, and consequently the larger the drag established by sea anchor assembly 10. In order to provide for fast action to open the outlet end, a quick-release device, such as a clip (not shown) may be employed for the control lines 21A and 21B with mooring line 19 to permit full opening of the assembly 10. While the number of such grommets 30—30 preferably totals at least six, it has been found desirable to provide at least eight, and preferably twelve (see FIG. 5), such equally arcuately spaced grommets to achieve appropriate control of the size of the outlet opening.

The mooring means includes four equally arcuately spaced webs, each of which are secured along the entire length of the outer surface of the cylindrical tubular body, and along axes generally parallel to the central axis of the cylindrical tubular body.

The control means, as indicated, comprises a pair of line segments 21A and 21B, each of which occupies essentially 180° of arc of the outlet opening at the proximal end of the sea anchor. These line segments pass through line-receiving grommets 30—30 in order to permit adjustable closure of the outlet end. The arrangement of the structure is such that a partial closure of the outlet end constricts the flow of water through the cylindrical tubular body, while the full opening of the outlet end permits unimpeded flow of water through the cylindrical tubular body. The utilization of the cylindrical tubular structure enhances the ability of the sea anchor robe readily deployed, without risking unintended inversion of the structure upon or after entering the water. The utilization of a symmetrically designed cylindrical tube also reduces the tendency of the device to rotate or wind-up when used in either the open or closed form.

By way of materials of construction, cylindrical tubular body 18 is prepared from a fabric such as closely-woven nylon, or other durable material. A weave of a polyester material such as that offered by E. I. DuPont deNemours Co. of Wilmington, Del. under the trademark "Dacron" may also be employed. The individual webbing forming the mooring lines 23—23 are also typically fabricated of nylon, although reinforced cloth is suitable. One advantage of the utilization of synthetic materials such as nylon or a polyester such as "Dacron" is that the structure is resistant to unintended rot if put away or stored while wet, or otherwise exposed to wet and/or humid environments over extended periods of time. The grommets 30—30 are typically and ideally fabricated of brass or stainless steel so as to avoid rust and/or corrosion if exposed to salt water.

While the overall diameter of the sea anchor of the present invention is selected by the user for its intended application, for most sport fishing applications, a diameter of at least 18" is desirable in order to achieve the appropriate amount of drag. Larger diameters will, of course, provide a greater drag force when utilized. The length of the cylindrical tubular body should typically be in the range of two times the diameter, thereby achieving appropriate inflation upon deployment.

It will be appreciated that the preferred embodiment illustrated herein is given for purposes of illustration only, and those skilled in the art may depart from the specific embodiment without actually departing from the spirit and scope of the present invention.

What is claimed is:

1. In a sea anchor drag means including a cylindrical tubular body with a central axis, and with an inlet opening formed at the proximal end thereof and an outlet opening formed at the distal end thereof and in opposed relationship to said inlet opening, mooring means including lines for deploying said cylindrical tubular body and for the secure coupling of said cylindrical tubular body to a vessel, flow control means for controllably and adjustably constricting the size of said outlet opening to adjust the drag force of said sea anchor drag means; the sea anchor drag means being further characterized in that:

(a) said cylindrical tubular body comprises an elongated cylindrical member with a central axis, and with a constant diameter from said inlet opening to said outlet opening, and having a plurality of line-receiving grommets positioned at equally arcuately spaced positions along said outlet opening;

(b) said mooring means comprises at least three webs having elongated portions thereof secured to the outer periphery and along axes parallel to the central axis of said cylindrical tubular body, with said webs being disposed at generally equally arcuately spaced positions along said cylindrical tubular body;

(c) said flow control means comprising at least one line segment extending from a point spaced outwardly from said proximal end to said distal end, and passing through said line-receiving grommets to permit adjustable closure of said outlet end, the arrangement being such that the partial closure of said outlet end reduces the area of said outlet opening to constrict the flow of water through said cylindrical tubular body while the expansion of said outlet end enlarges the area of said outlet opening to permit unimpeded flow of water through said cylindrical tubular body; and (d) said flow control means comprising at least a pair of said line segments, wherein each of said line segments have a mid-section and which are secured together, and wherein separate said line-receiving grommets are provided for each said line segment and with said grommets being arranged in pairs and with the members of each pair being disposed in oppositely disposed relationship, one to the other across Said cylindrical tubular body to facilitate symmetrical closing of said outlet opening.

2. The sea anchor means as defined in claim 1 being particularly characterized in that said webbing in said mooring means extends along the entire length of said cylindrical tubular body.

3. The sea anchor means as defined in claim 2 being particularly characterized in that said mooring means includes at least four webs secured to the outer periphery of said cylindrical tubular body.

4. The sea anchor means as defined in claim 1 being particularly characterized in that said cylindrical tubular body is prepared from nylon fabric.

5. The sea anchor means as defined in claim 1 being particularly characterized in that said cylindrical tubular body is generally impervious to the flow of water therethrough.

6. The sea anchor means as defined in claim 1 being particularly characterized in that said cylindrical tubular body has a diameter of at least 18'.

7. The sea anchor means as defined in claim 1 being particularly characterized in that webbing is securely attached to the outer periphery of said inlet and outlet openings.

* * * * *

UNITED STATES PATENT AND TRADEMARK OFFICE

CERTIFICATE OF CORRECTION

PATENT NO. : 5,394,817

DATED : March 7, 1995

INVENTOR(S) : Stewart Kaufman

It is certified that error appears in the above-indentified patent and that said Letters Patent is hereby corrected as shown below:

column 6, line 7, "Said" should read -- said --.
Line 27, "18'" should read -- 18" --.

Signed and Sealed this

Sixteenth Day of May, 1995

*Attest:*

*Attesting Officer*

BRUCE LEHMAN

*Commissioner of Patents and Trademarks*